US005808239A

United States Patent [19]

Olsson

[11] Patent Number: 5,808,239

[45] Date of Patent: Sep. 15, 1998

[54] VIDEO PUSH-CABLE

[75] Inventor: Mark S. Olsson, San Diego, Calif.

[73] Assignee: Deepsea Power & Light

[21] Appl. No.: 609,098

[22] Filed: Feb. 29, 1996

[51] Int. Cl.[6] ..... H01B 11/06

[52] U.S. Cl. ..... 174/113 C; 174/131 A

[58] Field of Search ..... 174/113 C, 113 R, 174/113 A, 113 AS, 131 A, 36; 156/47, 51

[56] References Cited

U.S. PATENT DOCUMENTS

| | | | |
|---|---|---|---|
| 3,594,491 | 7/1971 | Zeidlhack | 174/36 X |
| 3,678,177 | 7/1972 | Lawrenson | 174/113 C |
| 4,365,865 | 12/1982 | Stiles | 350/96.23 X |
| 4,766,669 | 8/1988 | Schwartzman | 29/828 X |
| 4,767,890 | 8/1988 | Magnan | 174/28 X |
| 4,997,992 | 3/1991 | Low | 174/24 X |
| 5,120,905 | 6/1992 | Cousin et al. | 174/113 C |
| 5,122,622 | 6/1992 | Reuss et al. | 174/113 C |
| 5,313,020 | 5/1994 | Sackett | 174/113 C |
| 5,408,560 | 4/1995 | Seynhaeve et al. | 385/101 X |
| 5,457,288 | 10/1995 | Olsson | 174/117 |
| 5,519,173 | 5/1996 | Newmoyer et al. | 174/113 R |

OTHER PUBLICATIONS

*TV Sewer Inspection Cables,* Product Bulletin A–100, Boston Insulated Wire and Cable Company, Ltd., May 1989.

*Multiconductor Cable Specifications: Fiber Armor,* UEMSI, Apr. 1992.

*Primary Examiner*—Kristine L. Kincaid
*Assistant Examiner*—Chau N. Nguyen
*Attorney, Agent, or Firm*—Michael H. Jester

[57] ABSTRACT

A push-cable for mechanically and electrically connecting a video camera head to a push reel and a video circuit includes a central resilient push rod made of a composite material such as resin impregnated glass fibers, and a plurality of conductive wires and filler rods helically wound around the push rod. The push-cable further includes a conductive shield layer surrounding the conductive wires and filler rods and sandwiched between inner and outer layers of plastic film tape. A layer of a high pull strength material such as braided KEVLAR surrounds and overlies the film-enclosed conductive shield. The final layer of the push-cable is a co-polymer polypropylene insulating protective layer. The configuration and geometry of the components of the push-cable are preferably designed to achieve a seventy-five ohm impedence and a high signal-to-noise ratio over an extended length.

8 Claims, 2 Drawing Sheets

VIDEO PUSH-CABLE

BACKGROUND OF THE INVENTION

The present invention relates to electromechanical systems for inspecting the inside of pipes for defects and obstructions, and more particularly, to a push-cable for use in such a system that mechanically and electrically connects a video camera head to a push reel and video circuit.

There are many situations in which it is desirable to inspect the inside of a pipe which is already in place, either underground, in a building, or underwater. For example, sewer and drain pipes frequently need to be internally inspected to determine if there are any obstructions or degradations in couplings which prevent free flow of waste material. It is also desirable to internally inspect steam pipes, heat exchanger pipes, water pipes, gas pipes, electrical conduits and fiberoptic conduits. Frequently, pipes which are to be inspected have an internal diameter of six inches or less. It is sometimes necessary to inspect several hundred feet of pipe.

Over the years, video pipe inspection systems have been developed which typically include a camera which is forced down the interior of the pipe so that its internal walls can be inspected on a video display. Conventional video pipe inspection systems include a push-cable which provides an electromechanical connection between a rugged head enclosing the video camera and a rotatable push reel which is used to pay out the cable and force the down the pipe. Typically, the push-cable incorporates a conventional co-axial cable. Both the relatively stiff mechanical portion of the cable and the electrical portion thereof are arranged in a concentric bundle. Problems arise because the push-cable must be sufficiently stiff in order that the head containing the video camera can be pushed hundreds of feet down the inside of a pipe. However, the cable must also be able to bend sharply so that the video camera head can be forced through a number of tight turns which may include relatively sharp angles, such as ninety degrees.

Heretofore, conventional push-cables which have been constructed for video pipe inspection systems have utilized a miniature seventy-five ohm impedance coaxial cable to carry the video signal. This miniature co-axial cable is relatively expensive and is delicate. Its center conductor wire is relatively small and breaks easily, especially at the end terminations. Another significant disadvantage of the miniature seventy-five ohm coaxial cable is that it tends to have high losses and reduced signal strength of the transmitted video data over lengths even as short as one hundred feet. A reduction in video signal strength results in a loss of fine detail or resolution as well as image contrast in the displayed video. The high frequency part of the video image is attenuated more severely than the lower frequency part of the signal.

Besides improving its signal-to-noise ratio and bandwidth, it would also be desirable to reduce the diameter of a push-cable utilized for video pipe inspection. In general a smaller, lighter push-cable can be pushed further into a pipe.

SUMMARY OF THE INVENTION

It is therefore the primary object of the present invention to provide an improved push-cable construction for use in a video pipe inspection system.

The video push-cable of the present invention comprises a central resilient push rod, at least one insulated conductive wire adjacent the push rod, a conductive shield layer surrounding the insulated conductive wire and the push rod, and an outer insulating protective layer surrounding the shield layer.

DETAILED DESCRIPTION OF THE PREFERRED EMBODIMENTS

Figure 1:
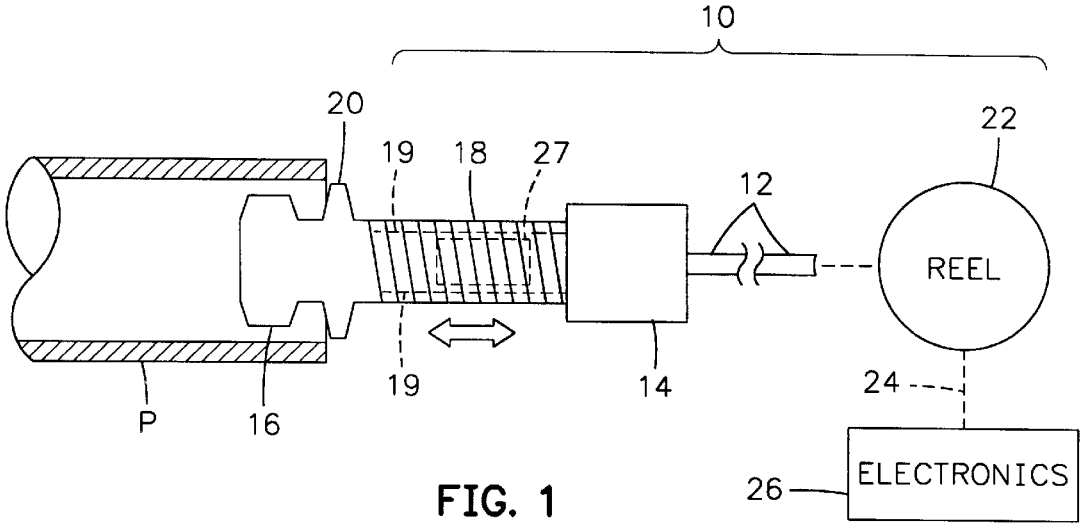
FIG. 1 is a diagrammatic view illustrating a video pipe inspection system utilizing the preferred embodiment of the push-cable of the present invention.

FIG. 1 illustrates in diagrammatic form a video pipe inspection system 10 which utilizes a preferred embodiment 12 of my video push-cable. The forward, or distal, end of the push-cable 12 is coupled through an electromechanical termination assembly 14 to a rugged head 16 which contains a small charge-coupled-device (CCD) black and white video camera. A coil spring 18 surrounds the push-cable 12 and is coupled between the rear end of the head 16 and the termination assembly 14. The spring 18 provides the correct amount of flexibility to permit the head 16 to negotiate tight turns when inserted down the inside of a pipe P. Two stainless steel aircraft type cables 19 connect the head 16 to the termination assembly 14. The cables 19 extend inside the spring 18 and limit its extension. This facilitates removal of the head 16 from the pipe if it were to get stuck.

Optional deformable fins 20 extend radially from the head 16 to centrally position the head within the pipe P. The cable 12 may extend several hundred feet between the termination assembly 14 and a push reel 22. This reel is normally several feet in diameter. The reel 22 may comprise a molded plastic housing having an internal hub about which the cable 12 is wound, and an external annular wall for restraining and holding the multiple turns of the push-cable 12.

The rearward, or proximal end of the cable 12 is electrically connected through a slip-ring coupling (not illustrated) inside the push reel 22 and a signal transmission line 24 to the system electronics 26. The electronics include a conventional high-resolution black and white monitor (not illustrated) with an integrated power supply.

The rugged head 16 is preferably designed for pipes having a diameter as small as two inches. Within two years it is expected that the head 16 can be designed to fit within pipes having a one inch diameter due to ongoing video camera miniaturization. Built into the front end of the head are fifteen red LEDs (not illustrated) which provide sufficient illumination for the red-spectrum sensitive CCD camera. The video camera itself is preferably a fixed focus, wide angle camera providing substantial depth of field, thereby eliminating the need for remote focus in most applications.

By way of example, the head 16 may measure approximately one and three-quarters inches in diameter and two and one-quarter inches in length. The coil spring 18 relieves strain and also protects the push-cable and camera connectors from wear and tear while allowing the head 16 to flex around multiple ninety degree turns. Preferably, the head 16 is made of stainless steal and includes a sapphire crystal window (not illustrated) highly resistant to scratching. The camera inside the head 16 is completely self-contained. Preferably the head 16 is waterproof to a depth of at least three-hundred and thirty feet and a pressure of at least one-hundred and fifty PSI.

An optional RF transmitter 27 is located inside the coil spring 18 and is powered by current received through a cord (not illustrated) connected through the termination assembly 14 to the cable 12. The transmitter 27 is preferably a 512 Hz transmitter operating on the same power as the camera inside the head 16. Once installed, an operator can locate the head 16 up to fifteen feet underground in cast iron pipe, while traveling multiple ninety degree bends.

Once suitable CCD camera for use inside the head 16 is the Model CX060-3 manufactured by CHINON AMERICA, INC. One suitable black and white monitor for use in the electronics 26 is the Model EXM990 manufactured by ELBEX.

Figure 2:
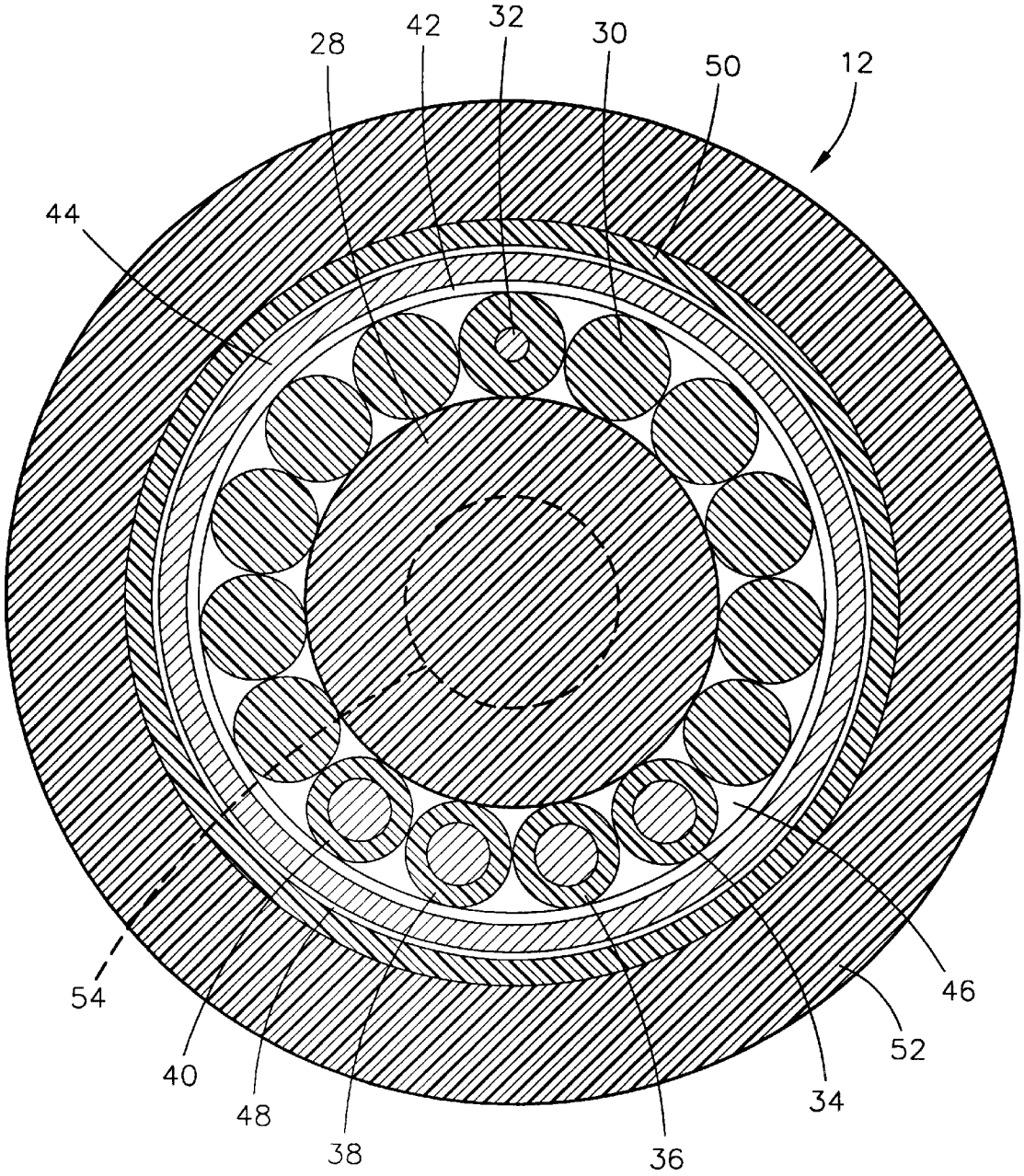
FIG. 2 is a greatly enlarged cross-section view of the preferred embodiment of the push-cable of the present invention.

Referring to FIG. 2, the preferred embodiment of my cable 12 has a multi-layer construction specifically designed to be resilient and light enough to push the rugged video camera head 16 down the pipe P. The construction of the cable 12 allows it to negotiate multiple ninety degree turns, while at the same time providing a high signal-to-noise ratio with approximately seventy-five ohms of impedance. This impedance matches that of conventional video monitoring hardware such as the aforementioned video camera and black and white monitor. The preferred embodiment of my cable 12 does not utilize the miniature seventy-five ohm coaxial cable incorporated into prior art video push-cables.

The preferred embodiment 12 of my video push-cable has relatively small outside diameter, namely, 0.420 inches. This helps the rugged head 16 negotiate tight turns hundreds of feet into the pipe P. Also, the smaller diameter of my video push-cable 12 results in less weight, and a smaller pack diameter on the push reel 22 than those of conventional video pipe inspection systems.

Figure 3:
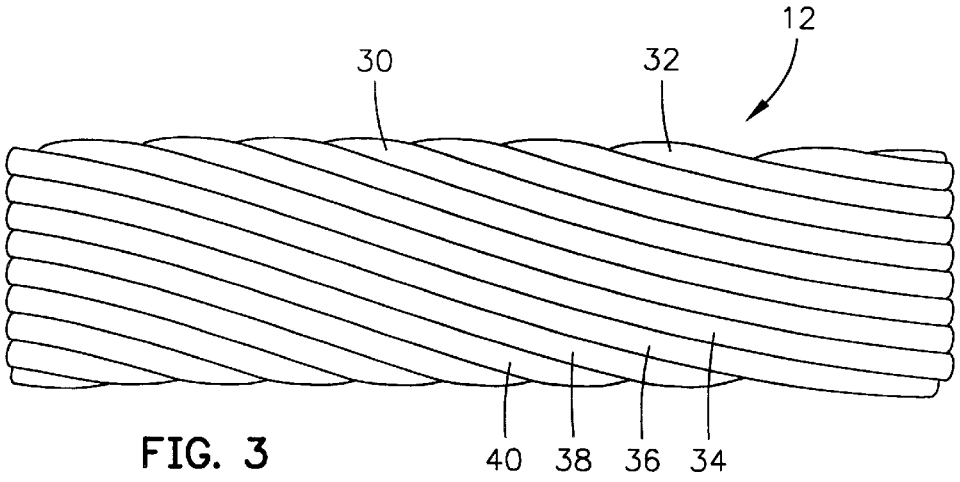
FIG. 3 is a greatly enlarged, fragmentary side elevation view of the preferred embodiment of the push-cable of the present invention with its outer layers removed to reveal the helical wrap angle of its filler rods and conductive wires.

The cable 12 includes a central composite push rod 28 preferably made of high strength resin impregnated fiberglass. By way of example, the outside diameter of the rod 28 may be 0.170 inches. One suitable composite material for the rod 28 is 10-170-URO commercially available from JAMESON CORPORATION. It provides a suitable amount of strength and resilience. Surrounding and overlying the composite rod 28 are ten smaller filler rods 30 and five separate insulated conductive wires 32, 34, 36, 38 and 40 arranged in the order illustrated in FIG. 2. These filler rods and wires are wrapped in a helical pattern about the composite rod 28 as shown in FIG. 3. The wrap angle, i.e. the angle between the central axis of the composite rod 28 and the axes of the filler rods 30 and insulated wires 32–40 is approximately thirty degrees. By way of example, the helical wrap angle of the filler rods 30 and insulated wires 32–40 is such that they achieve one wrap or revolution for each three and one-half to four inches of linear length of the cable 12. The reason for this wrap angle is to minimize stresses induced in the filler rods 30 and insulated wires 32–40 which would otherwise be induced by sharp bends in the cable 12. This helical wrapping provides sufficient slack during such bending to inhibit stretching or breakage of the filler rods and insulated wires.

By way of example, the filler rods 30 may be made of polypropylene, polyethylene or center NYLON filament, and may have an outer diameter of approximately 0.044 inches. The insulated conductive wire 32 may comprise 28AWG stranded wire, having TFE or FEP or other low dielectric outer insulation, and an outer diameter of approximately 0.0480 inches. The insulated conductive wires 34, 36, 38 and 40 may comprise 22AWG insulated wire with polypropylene, NYLON, polyolefin, FEP or PFE coating, with an outside diameter of approximately 0.0440 inches.

The insulated conductive wire 32 may be used to transmit the actual video signal from the video camera inside the head 16 to the electronics 26. The insulated wires 34, 36, 38 and 40 may be collectively used to carry the electric power to the camera inside the head 16.

Surrounding and overlying the filler rods 30 and insulated conductive wires 32–40 is an inner insulating layer 42 preferably made of MYLAR plastic film in the form of tape having a thickness of approximately 0.006 inches and overlapped seventy-five percent. Surrounding and overlying the inner insulating layer 42 is a conductive shield layer 44. The conductive shield layer 44 is preferably made of braided metal filaments having a high flexibility and braid angle with approximately ninety percent nominal coverage. It will thus be understood that the video signal is carried over the wire 32 and the power to the camera is carried collectively over the four insulated wires 34–40. All of these wires are contained within, and lie immediately adjacent to, the shield layer 44, thereby minimizing signal disturbance. The shield layer 44 could alternatively also be formed of a single layer of metal filaments that all helically wind around the rod 28 in the same direction.

The configuration and geometry of my video push-cable 12 is extremely important in providing the required seventy-five ohm impedance and high signal to noise ratio. The impedance is determined by the geometry of the shield layer 44, the spacing of the insulated wire 32 therefrom, the size of the insulated wire itself, and the dielectric properties of the materials between the layer 44 and wire 32. The impedance is also determined by the size and spacing of the air gaps 46 (FIG. 2) which exist between the individual filler rods 30, the wires 32–40 and the shield layer 44. The gaps 46 could be filled with a solid dielectric material in certain applications. This would necessitate slight design modifications to compensate for the resulting lower impedance.

Surrounding and overlying the conductive shield layer 44 is a second intermediate insulating layer 48 also preferably made of MYLAR plastic film in the form of tape, having a thickness of approximately 0.003 inches. Again this layer preferably has a seventy-five percent overlap. Outside the second insulating layer 48 is a high pull strength layer 50 preferably made of braided KEVLAR material. The layer 48 is extremely strong, having a nominal break resistance of several hundred pounds. It also has tremendous cut resistance. The braided KEVLAR layer 50 is highly stiff and has a high braid lay angle. The KEVLAR layer 50 has a thickness of approximately 0.0100 inches.

The final outer layer of the preferred embodiment 12 of my cable is a third insulating protective layer 52 preferably made of high density co-polymer polypropylene, such as EXXON PD7031. The thickness of this outer layer 52 is 0.050 inches. It may also be made of polypropylene, polyethylene, or a blend of polypropylene and polyethylene.

Whereas I have described a preferred embodiment of my push-cable for use in a video pipe inspection system, it will be apparent to those skilled in the art that my invention may be modified in both arrangement and detail. For example, one or more of the insulated wires 32–40 could be replaced with fiberoptic cables. One or more of the filler rods 30 could be replaced with fiberoptic cables. Similarly, one or more of the filler rods 30 could be replaced with insulated wires.

The solid rod 28 could be replaced with a hollow tube forming a hose to allow water to be pumped through the same at high pressure, e.g. 1,000–5,000 p.s.i. This water could be ejected in jets to help pull the push-cable through a pipe and wash its interior. The bore of such a push rod is shown in phantom lines at 54 in FIG. 2.

In another alternate embodiment of my single or multi-signal construction, the braided shield layer 44 could be replaced with a MYLAR plastic film shield having an inwardly facing metallized surface. This would provide a very thin, light-weight smaller diameter construction. One or more of the filler rods 30 could be replaced with bare, uninsulated Silver or Tin-Plated Copper ("TC") drain wires, thereby allowing contact between the metallized surface of the MYLAR plastic film and the drain wires. These same drain wires could optionally contact the outer surface of the rod 28 if the core were wrapped with MYLAR film having an outwardly facing metallized surface. The drain wires could be placed in such a way to provide good electrical shielding and isolation between adjacent signal wires and between the signal wires and the signal/power wires within the construction. Essentially, individually isolated coaxial transmission paths could be created in this manner. For specialized applications, such as remote head CCD cameras where large numbers of micro-coax cables are employed, a two or more layer construction could be employed using several rings of signal conductors.

The preferred embodiment of my video push-cable 12 could be substituted for the signal cable in the dual-push-cable disclosed in my U.S. Pat. No. 5,457,288 granted Oct. 10, 1995, the entire disclosure of which is specifically incorporated herein by reference.

Accordingly, the protection afforded my invention should only be limited in accordance with the scope of the following claims.

I claim:

1. A video push-cable comprising:

a central resilient composite push rod made of resin impregnated fibers;

a plurality of insulted conductive wires helically wrapped around the push rod;

a plurality of filler rods helically wrapped around the push rod;

a conductive shield layer surrounding and overlying the insulated conductive wires and push rod; and an outer insulating protective layer surrounding the shield layer.

2. A video push-cable according to claim 1 and further comprising an inner insulating layer surrounding and overlying the conductive wires and filler rods.

3. A video push-cable according to claim 2 and further comprising an intermediate insulating layer surrounding and overlying the shield layer.

4. A video push-cable according to claim 1 and further comprising a layer of high strength material surrounding and overlying the shield layer.

5. A video push-cable according to claim 1 wherein the push rod, conductive wires, filler rods and shield are dimensioned and configured so that the push-cable has an impedance of approximately seventy-five ohms.

6. A video push-cable according to claim 1 wherein the outer insulating protective layer is made from a material selected from the group consisting of polyethylene, polypropylene and a blend of polyethylene and polypropylene.

7. A video push-cable according to claim 1 wherein the conductive wires each have a coating of insulation.

8. A video push-cable comprising:

a central resilient composite push rod made of resin impregnated fibers;

a plurality of insulated conductive wires helically wound around the push rod;

a plurality of filler rods helically wound around the push rod;

an inner insulating layer of plastic film surrounding and overlying the conductive wires and push rods;

a conductive shield layer surrounding and overlying the inner insulating layer;

an intermediate insulating layer of plastic film overlying the shield layer;

a layer of a high pull strength material surrounding and overlying the intermediate insulating layer; and an outer insulating protective layer surrounding and overlying the layer of high pull strength material.

* * * * *